United States Patent [19]

Field

[11] 4,443,326

[45] Apr. 17, 1984

[54] TWO-STEP REFORMING PROCESS

[75] Inventor: Leslie A. Field, Oakland, Calif.

[73] Assignee: Chevron Research Company, San Francisco, Calif.

[21] Appl. No.: 465,406

[22] Filed: Feb. 10, 1983

Related U.S. Application Data

[63] Continuation-in-part of Ser. No. 311,834, Oct. 16, 1981, abandoned.

[51] Int. Cl.[3] ..... C10G 35/04

[52] U.S. Cl. ..... 208/64; 208/134; 208/138; 585/419

[58] Field of Search ..... 208/64, 134, 138; 585/419

[56] References Cited

U.S. PATENT DOCUMENTS

| | | | |
|---|---|---|---|
| 3,783,123 | 1/1974 | Young | 208/111 |
| 3,925,191 | 12/1975 | Burgess | 208/66 |
| 3,928,174 | 12/1975 | Bonacci et al. | 208/66 |
| 4,224,141 | 9/1980 | Morrison et al. . | |

FOREIGN PATENT DOCUMENTS 32414 7/1981 European Pat. Off. .

*Primary Examiner*—Curtis R. Davis

*Attorney, Agent, or Firm*—D. A. Newell; S. R. LaPaglia; E. A. Schaal

[57] ABSTRACT

A hydrocarbon conversion process is disclosed wherein a hydrocarbon feed is contacted with a dehydrocyclization catalyst containing a large-pore zeolite and a Group VIII metal, then the resulting reformate is upgraded using an intermediate pore size zeolite.

24 Claims, No Drawings

TWO-STEP REFORMING PROCESS

CROSS-REFERENCE TO RELATED APPLICATION

This is a continuation-in-part of application Ser. No. 311,834, filed Oct. 16, 1981 and now abandoned.

BACKGROUND OF THE INVENTION

The invention relates to a new hydrocarbon conversion process wherein a hydrocarbon feed is contacted with a new dehydrocyclization catalyst which has a superior selectivity for dehydrocyclization, and then the resulting reformate is upgraded using an intermediate pore size zeolite.

Catalytic reforming is well known in the petroleum industry and refers to the treatment of naphtha fractions to improve the octane rating by the production of aromatics. The more important hydrocarbon reactions occurring during reforming operation include dehydrogenation of cyclohexanes to aromatics, dehydroisomerization of alkylcyclopentanes to aromatics, and dehydrocyclization of acyclic hydrocarbons to aromatics. A number of other reactions also occur, including the following: dealkylation of alkylbenzenes, isomerization of paraffins, and hydrocracking reactions which produce light gaseous hydrocarbons, e.g., methane, ethane, propane and butane. Hydrocracking reactions are to be particularly minimized during reforming as they decrease the yield of products in the gasoline boiling range and hydrogen.

Because of the demand for high octane gasoline for use as motor fuels, etc., extensive research is being devoted to the development of improved reforming catalysts and catalytic reforming processes. Catalysts for successful reforming processes must possess good selectivity, i.e., be able to produce high yields of liquid products in the gasoline boiling range containing large concentrations of high octane number aromatic hydrocarbons and accordingly, low yields of light gaseous hydrocarbons. The catalysts should possess good activity in order that the temperature required to produce a certain quality product need not be too high. It is also necessary that catalysts either possess good stability in order that the activity and selectivity characteristics can be retained during prolonged periods of operation, or be sufficiently regenerable to allow frequent regeneration without loss of performance.

Catalysts comprising platinum, for example, platinum supported on alumina, are well known and widely used for reforming of naphthas. The most important products of catalytic reforming are benzene, alkylbenzenes, and hydrogen. The aromatic hydrocarbons are of great value as high octane number components of gasoline. The hydrogen is useful elsewhere in the refinery, for instance, for processing of high boiling feedstreams, to remove heteroatoms and to crack them into lighter boiling ranges.

Catalytic reforming is also an important process for the chemical industry because of the great demand for aromatic hydrocarbons for use in the manufacture of various chemical products such as synthetic fibers, insecticides, adhesives, detergents, plastics, synthetic rubbers, pharmaceutical products, high octane gasoline, perfumes, drying oils, ion-exchange resins, and various other products well known to those skilled in the art. One example of a process to meet this demand is the manufacture of alkylated aromatics such as ethylbenzene, cumene and dodecylbenzene by using the appropriate monoolefins to alkylate benzene. Another example is in the area of chlorination of benzene to give chlorobenzene which is then used to prepare phenol by hydrolysis with sodium hydroxide. The chief use for phenol is in the manufacture of phenol-formaldehyde resins and plastics. Another route to phenol uses cumene as a starting material and involves the oxidation of cumene by air to cumene hydroperoxide which can then be decomposed to phenol and acetone by the action of an appropriate acid. The demand for ethylbenzene is primarily derived from its use to manufacture styrene by selective dehydrogenation; styrene is in turn used to make styrene-butadiene rubber and polystyrene. Ortho-xylene is typically oxidized to phthalic anhydride by reaction in vapor phase with air in the presence of a vanadium pentoxide catalyst. Phthalic anhydride is in turn used for production of plasticizers, polyesters and resins. The demand for para-xylene is primarily because of its use in the manufacture of terephthalic acid or dimethylterephthalate which in turn is reacted with ethylene glycol and polymerized to yield polyester fibers. Substantial demand for benzene also is associated with its use to produce aniline, nylon, maleic anhydride, solvents and the like petrochemical products. Toluene, on the other hand, is not, at least relative to benzene and the $C_8$ aromatics, in great demand in the petrochemical industry as a basic building block chemical; consequently, substantial quantities of toluene are hydrodealkylated to benzene or disproportionated to benzene and xylene. Another use for toluene is associated with the transalkylation of trimethylbenzene with toluene to yield xylene.

Responsive to this demand for these aromatic products, the art has developed and industry has utilized a number of alternative methods to produce them in commercial quantities. One response has been the construction of a significant number of catalytic reformers dedicated to the production of aromatic hydrocarbons for use as feedstocks for the production of chemicals. As is the case with most catalytic processes, the principal measure of effectiveness for catalytic reforming involves the ability of the process to convert the feedstocks to the desired products over extended periods of time with minimum interference of side reactions.

The dehydrogenation of cyclohexane and alkylcyclohexanes to benzene and alkylbenzenes is the most thermodynamically favorable type of aromatization reaction of catalytic reforming at reforming conditions. This means that dehydrogenation of cyclohexanes can yield a higher ratio of (aromatic product/nonaromatic reactant) than either of the other two types of aromatization reactions at a given reaction temperature and pressure. Moreover, the dehydrogenation of cyclohexanes is the fastest of the three aromatization reactions. As a consequence of these thermodynamic and kinetic considerations, the selectivity for the dehydrogenation of cyclohexanes is higher than that for dehydroisomerization or dehydrocyclization. Dehydroisomerization of alkylcyclopentanes is somewhat less favored, both thermodynamically and kinetically. Its selectivity, although generally high, is lower than that for dehydrogenation. Dehydrocyclization of paraffins is also less favored both thermodynamically and kinetically. In conventional reforming, its selectivity is much lower than that for the other two aromatization reactions.

The selectivity disadvantage of paraffin dehydrocyclization is particularly large for the aromatization of compounds having a small number of carbon atoms per molecule. Dehydrocyclization selectivity in conventional reforming is very low for $C_6$ hydrocarbons. It increases with the number of carbon atoms per molecule, but remains substantially lower than the aromatization selectivity for dehydrogenation or dehydroisomerization of naphthenes having the same number of carbon atoms per molecule. A major improvement in the catalytic reforming process will require, above all else, a drastic improvement in dehydrocyclization selectivity that can be achieved while maintaining adequate catalyst activity and stability.

In the dehydrocyclization reaction, acyclic hydrocarbons are both cyclized and dehydrogenated to produce aromatics. The conventional methods of performing these dehydrocyclization reactions are based on the use of catalysts comprising a noble metal on a carrier. Known catalysts of this kind are based on alumina carrying 0.2% to 0.8% by weight of platinum and preferably a second auxiliary metal.

A disadvantage of conventional naphtha reforming catalysts is that with $C_6$–$C_8$ paraffins, they are usually more selective for other reactions (such as hydrocracking) than they are for dehydrocyclization. A major advantage of the catalyst used in the first stage of the present invention is its high selectivity for dehydrocyclization.

The possibility of using carriers other than alumina has also been studied and it was proposed to use certain molecular sieves such as X and Y zeolites, which have pores large enough for hydrocarbons in the gasoline boiling range to pass through. However, catalysts based upon these molecular sieves have not been commercially successful.

In the conventional method of carrying out the aforementioned dehydrocyclization, acyclic hydrocarbons to be converted are passed over the catalyst, in the presence of hydrogen, at temperatures on the order of 500° C. and pressures of from 5 to 30 bars. Part of the hydrocarbons are converted into aromatic hydrocarbons, and the reaction is accompanied by isomerization and cracking reactions which also convert the paraffins into isoparaffins and lighter hydrocarbons.

The rate of conversion of the acyclic hydrocarbons into aromatic hydrocarbons varies with the number of carbon atoms per reactant molecule, reaction conditions and the nature of the catalyst.

The catalysts hitherto used have given moderately satisfactory results with heavy paraffins, but less satisfactory results with $C_6$–$C_8$ paraffins, particularly $C_6$ paraffins. Catalysts based on a type L zeolite are more selective with regard to the dehydrocyclization reaction; can be used to improve the rate of conversion to aromatic hydrocarbons without requiring higher temperatures than those dictated by thermodynamic considerations (higher temperatures usually have a considerable adverse effect on the stability of the catalyst); and produce excellent results with $C_6$–$C_8$ paraffins, but catalysts based on type L zeolite have not achieved commercial usage, apparently because of inadequate stability.

In one method of dehydrocyclizing aliphatic hydrocarbons, hydrocarbons are contacted in the presence of hydrogen with a catalyst consisting essentially of a type L zeolite having exchangeable cations of which at least 90% are alkali metal ions selected from the group consisting of ions of lithium, sodium, potassium, rubidium and cesium and containing at least one metal selected from the group which consists of metals of Group VIII of the Periodic Table of Elements, tin and germanium, said metal or metals including at least one metal from Group VIII of said Periodic Table having a dehydrogenating effect, so as to convert at least part of the feedstock into aromatic hydrocarbons.

A particularly advantageous embodiment of this method is a platinum/alkali metal/type L zeolite catalyst containing cesium or rubidium because of its excellent activity and selectivity for converting hexanes and heptanes to aromatics, but stability remains a problem.

SUMMARY OF THE INVENTION

The present invention overcomes the deficiencies of the prior art by contacting a hydrocarbon feed with a dehydrocyclization catalyst comprising a large-pore zeolite, an alkaline earth metal selected from the group consisting of barium, strontium and calcium and a Group VIII metal to reform hydrocarbons, and then the resulting reformate is upgraded using an intermediate pore size zeolite. The dehydrocyclization catalyst gives superior selectivity for converting acyclic hydrocarbons to aromatics than shown in prior art processes. This dehydrocyclization catalyst also gives satisfactory run length. The hydrocarbon feed is first contacted with a dehydrocyclization catalyst comprising a large-pore zeolite (preferably type L zeolite), at least one Group VIII metal (preferably platinum); and an alkaline earth metal selected from the group consisting of barium, strontium and calcium (preferably barium).

Preferably, the dehydrocyclization catalyst contains: (a) a type L zeolite containing from 0.1% to 5% by weight platinum (preferably from 0.1% to 1.5% by weight platinum) and 0.1% to 40% by weight barium (preferably from 0.1% to 35% by weight barium, more preferably from 1% to 20% by weight barium); and (b) an inorganic binder. The majority of the type L zeolite crystals are preferably greater than 500 Angstroms, more preferably greater than 1000 Angstroms. In the most preferred embodiment, at least 80% of the crystals of type L zeolite are greater than 1000 Angstroms. The inorganic binder is preferably either a silica, alumina, or aluminosilicate. This binder can be either acidic or non-acidic. The hydrocarbons are contacted with the barium-exchanged type zeolite at a temperature of from 400° C. to 600° C. (preferably 450° C. to 550° C.); an LHSV of from 0.1 to 10 (preferably from 0.3 to 5); a pressure of from 1 atmosphere to 500 psig (preferably from 50 to 200 psig); and an $H_2$/HC ratio of from 0 to 20:1 (preferably from 2:1 to 6:1).

In a second zone, the reformate is contacted with the intermediate pore size zeolite bound with an inorganic binder at a temperature of from 800° to 1100° F., preferably at least 850° F. The pressure of the reaction when the reformate is contacted with zeolite is preferably from atmospheric pressure to 100 psig. The LHSV of that reaction is from 0.1 to 10, preferably from 0.1 to 2, and most preferably less than 1. The $H_2$/HC of that reaction is from 0 to 6, preferably less than 1, and most preferably about 0. Preferably, the intermediate pore size zeolite contains zinc. Preferably, the hydrocarbon feed is reformed to at least 75 F-1, clear in the first step and the reformate used in the second step is the $C_3$+ or $C_5$+ fraction of the reformate produced in the first step. Preferably, the reformate used in the second step contains at least 25 LV% aromatics.

DESCRIPTION OF THE PREFERRED EMBODIMENTS

In its broadest aspect, the present invention involves the dehydrocyclization of a hydrocarbon feed to form a reformate, then the resulting reformate is upgraded using an intermediate pore size zeolite. The dehydrocyclization is carried out using a dehydrocyclization catalyst comprising a large-pore zeolite, an alkaline earth metal, and a Group VIII metal.

The term "selectivity" as used in the present invention is defined as the percentage of moles of acyclic hydrocarbons converted to aromatics relative to moles converted to aromatics and cracked products, $$\text{i.e., Selectivity} = \frac{100 \times \text{moles of acyclic hydrocarbons converted to aromatics}}{\text{moles of acyclic hydrocarbons converted to aromatics and cracked products}}$$

Isomerization of paraffins and interconversion of paraffins and alkylcyclopentanes having the same number of carbon atoms per molecule are not considered in determining selectivity.

The selectivity for converting acyclic hydrocarbons to aromatics is a measure of the efficiency of the process in converting acyclic hydrocarbons to the desired and valuable products: aromatics and hydrogen, as opposed to the less desirable products of hydrocracking.

Highly selective catalysts produce more hydrogen than less selective catalysts because hydrogen is produced when acyclic hydrocarbons are converted to aromatics and hydrogen is consumed when acyclic hydrocarbons are converted to cracked products. Increasing the selectivity of the process increases the amount of hydrogen produced (more aromatization) and decreases the amount of hydrogen consumed (less cracking).

Another advantage of using highly selective catalysts is that the hydrogen produced by highly selective catalysts is purer than that produced by less selective catalysts. This higher purity results because more hydrogen is produced, while less low boiling hydrocarbons (cracked products) are produced. The purity of hydrogen produced in reforming is critical if, as is usually the case in an integrated refinery, the hydrogen produced is utilized in processes such as hydrotreating and hydrocracking, which require at least certain minimum partial pressures of hydrogen. If the purity becomes too low, the hydrogen can no longer be used for this purpose and must be used in a less valuable way, for example as fuel gas.

Feedstock

Regarding the feedstock used in the present invention, it is a naphtha boiling in the gasoline range, containing at least some acyclic hydrocarbons.

Preferably, the feedstock is substantially free of sulfur, nitrogen, metals, and other known poisons for reforming catalysts. This catalyst is especially sensitive to sulfur. The feedstock can be made substantially free of sulfur, nitrogen, metals, and other known poisons by conventional hydrofining techniques plus sorbers that remove sulfur compounds.

In the case of a feedstock which is not already low in sulfur, acceptable levels can be reacted by hydrofining the feedstock in a pretreatment zone where the naphtha is contacted with a hydrofining catalyst which is resistant to sulfur poisoning. A suitable catalyst for this hydrodesulfurization process is, for example, an alumina-containing support and a minor proportion of molybdenum oxide, cobalt oxide and/or nickel oxide. Hydrodesulfurization is ordinarily conducted at 315° C. to 455° C., at 200 to 2000 psig, and at a liquid hourly space velocity of 1 to 5. The sulfur and nitrogen contained in the naphtha are converted to hydrogen sulfide and ammonia, respectively, which can be removed prior to reforming by suitable conventional processes.

Dehydrocyclization Reaction

According to the present invention, the hydrocarbon feed is contacted with the catalyst in a dehydrocyclization zone maintained at dehydrocyclization conditions. This contacting may be accomplished by using the catalyst in a fixed bed system, a moving bed system, a fluidized system, or in a batch-type operation; however, in view of the danger of attrition losses of the valuable catalyst and of well-known operational advantages, it is preferred to use either a fixed bed system or a dense-phase moving bed system. It is also contemplated that the contacting step can be performed in the presence of a physical mixture of particles of a conventional dual-function catalyst of the prior art. In a fixed bed system, the hydrocarbon feed is preheated by any suitable heating means to the desired reaction temperature and then passed into a dehydrocyclization zone containing a fixed bed of the catalyst. It is, of course, understood that the dehydrocyclization zone may be one or more separate reactors with suitable means therebetween to ensure that the desired conversion temperature is maintained at the entrance to each reactor. It is also important to note that the reactants may be contacted with the catalyst bed in either upward, downward, or radial flow fashion. In addition, the reactants may be in a liquid phase, a mixed liquid-vapor phase, or a vapor phase when they contact the catalyst, with best results obtained in the vapor phase. The dehydrocyclization system then preferably comprises a dehydrocyclization zone containing one or more fixed beds or dense-phase moving beds of the catalyst. In a multiple bed system, it is, of course, within the scope of the present invention to use the present catalyst in less than all of the beds with a conventional dual-function catalyst being used in the remainder of the beds. The dehydrocyclization zone may be one or more separate reactors with suitable heating means therebetween to compensate for the endothermic nature of the dehydrocyclization reaction that takes place in each catalyst bed.

Although hydrogen is the preferred diluent for use in the subject dehydrocyclization method, in some cases other art-recognized diluents may be advantageously utilized, either individually or in admixture with hydrogen, such as $C_1$ to $C_5$ paraffins such as methane, ethane, propane, butane and pentane; the like diluents, and mixtures thereof. Hydrogen is preferred because it serves the dual function of not only lowering the partial pressure of the hydrocarbon feed, but also of suppressing the formation of hydrogen-deficient, carbonaceous deposits (commonly called coke) on the catalytic composite. Ordinarily, hydrogen is utilized in amounts sufficient to insure a hydrogen to hydrocarbon mole ratio of about 0 to about 20:1, with best results obtained in the range of about 2:1 to about 6:1. The hydrogen charged to the dehydrocyclization zone will typically be contained in a hydrogen-rich gas stream recycled from the effluent stream from this zone after a suitable gas/liquid separation step.

The hydrocarbon dehydrocyclization conditions used in the present method include a reactor pressure which is selected from the range of about 1 atmosphere to about 500 psig, with the preferred pressure being about 50 psig to about 200 psig. The temperature of the dehydrocyclization is preferably about 450° C. to about 550° C. As is well known to those skilled in the dehydrocyclization art, the initial selection of the temperature within this broad range is made primarily as a function of the desired conversion level of the hydrocarbon feed considering the characteristics of the charge stock and of the catalyst. Ordinarily, the temperature then is thereafter slowly increased during the run to compensate for the inevitable deactivation that occurs to provide a relatively constant value for conversion.

The liquid hourly space velocity (LHSV) used in the instant dehydrocyclization method is selected from the range of about 0.1 to about 10 hr.$^{-1}$, with a value in the range of about 0.3 to about 5 hr.$^{-1}$ being preferred.

Reforming generally results in the production of hydrogen. Thus, exogenous hydrogen need not necessarily be added to the reforming system except for prereduction of the catalyst and when the feed is first introduced. Generally, once reforming is underway, part of the hydrogen produced is recirculated over the catalyst. The presence of hydrogen serves to reduce the formation of coke which tends to poison the catalyst. Hydrogen is preferably introduced into the reforming reactor at a rate varying from 0 to about 20 moles of hydrogen per mole of feed. The hydrogen can be in admixture with light gaseous hydrocarbons.

If, after a period of operation, the catalyst has become deactivated by the presence of carbonaceous deposits, said deposits can be removed from the catalyst by passing an oxygen-containing gas, such as dilute air, into contact with the catalyst at an elevated temperature in order to burn the carbonaceous deposits from the catalyst. The regeneration can be performed either in the semiregenative mode in which the reforming operation is interrupted after a more or less long period of time and catalyst regeneration is carried out, or in the onstream regenerative mode, in which a portion of the catalyst is regenerated while the reforming operation is continued over the remainder of the catalyst. Two types of onstream regeneration are known in the prior art, cyclic and continuous reforming. In cyclic reforming, the catalyst in one of a series of reactors is regenerated while reforming is continued in the rest of the plant. In continuous reforming, a portion of deactivated catalyst is removed from the plant, regenerated in a separate regeneration system while reforming is continued in the plant, and the regenerated catalyst is returned to the plant. The method of regenerating the catalyst will depend on whether there is a fixed bed, moving bed, or fluidized bed operation. Regeneration methods and conditions are well known in the art.

The dehydrocyclization catalyst according to the invention is a large-pore zeolite charged with one or more dehydrogenating constituents. The term "large-pore zeolite" is defined as a zeolite having an effective pore diameter of 6 to 15 Angstroms.

Among the large-pored crystalline zeolites which have been found to be useful in the practice of the present invention, type L zeolite, zeolite X, zeolite Y and faujasite are the most important and have apparent pore sizes on the order of 7 to 9 Angstroms.

The chemical formula for zeolite Y expressed in terms of mole oxides may be written as:

$$(0.7\text{–}1.1)Na_2O:Al_2O_3:xSiO_2:yH_2O$$

wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007 is hereby incorporated by reference to show a zeolite useful in the present invention.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244. U.S. Pat. No. 2,882,244 is hereby incorporated by reference to show a zeolite useful in the present invention.

The preferred catalyst according to the invention is a type L zeolite charged with one or more dehydrogenating constituents.

Type L zeolites are synthetic zeolites. A theoretical formula is $M_{9/n}[(AlO_2)_9(SiO_2)_{27}]$ in which M is a cation having the valency n.

The real formula may vary without changing the crystalline structure; for example, the mole ratio of silicon to aluminum (Si/Al) may vary from 1.0 to 3.5.

Although there are a number of cations that may be present in zeolite L, in one embodiment, it is preferred to synthesize the potassium form of the zeolite, i.e., the form in which the exchangeable cations present are substantially all potassium ions. The reactants accordingly employed are readily available and generally water soluble. The exchangeable cations present in the zeolite may then conveniently be replaced by other exchangeable cations, as will be shown below, thereby yielding an isomorphic form of zeolite L.

In one method of making zeolite L, the potassium form of zeolite L is prepared by suitably heating an aqueous metal aluminosilicate mixture whose composition, expressed in terms of the mole ratios of oxides, falls within the range:

$K_2O/(K_2O+Na_2O)$ . . . From about 0.33 to about 1
$(K_2O+Na_2O)/SiO_2$ . . . From about 0.35 to about 0.5
$SiO_2/Al_2O_3$ . . . From about 10 to about 28
$H_2O/(K_2O+Na_2O)$ . . . From about 15 to about 41

The desired product is hereby crystallized out relatively free from zeolites of dissimilar crystal structure.

The potassium form of zeolite L may also be prepared in another method along with other zeolitic compounds by employing a reaction mixture whose composition, expressed in terms of mole ratios of oxides, falls within the following range:

$K_2O/(K_2O+Na_2O)$ . . . From about 0.26 to about 1
$(K_2O+Na_2O)/SiO_2$ . . . From about 0.34 to about 0.5
$SiO_2/Al_2O_3$ . . . From about 15 to about 28

$H_2O/(K_2O+Na_2O)$ . . . From about 15 to about 51

It is to be noted that the presence of sodium in the reaction mixture is not critical to the present invention.

When the zeolite is prepared from reaction mixtures containing sodium, sodium ions are generally also included within the product as part of the exchangeable cations together with the potassium ions. The product obtained from the above ranges has a composition, expressed in terms of moles of oxides, corresponding to the formula:

$$0.9\text{–}1.3[(1-x)K_2O,\ xNa_2O]:Al_2O_3:5.2\text{–}6.9SiO_2:yH_2O$$

wherein "x" may be any value from 0 to about 0.75 and "y" may be any value from 0 to about 9.

In making zeolite L, representative reactants are activated alumina, gamma alumina, alumina trihydrate and sodium aluminate as a source of alumina. Silica may be obtained from sodium or potassium silicate, silica gels, silicic acid, aqueous colloidal silica sols and reactive amorphous solid silicas. The preparation of typical silica sols which are suitable for use in the process of the present invention are described in U.S. Pat. No. 2,574,902 and U.S. Pat. No. 2,597,872. Typical of the group of reactive amorphous solid silicas, preferably having an ultimate particle size of less than 1 micron, are such materials as fume silicas, chemically precipitated and precipitated silica sols. Potassium and sodium hydroxide may supply the metal cation and assist in controlling pH.

In making zeolite L, the usual method comprises dissolving potassium or sodium aluminate and alkali, viz., potassium or sodium hydroxide, in water. This solution is admixed with a water solution of sodium silicate, or preferably with a water-silicate mixture derived at least in part from an aqueous colloidal silica sol. The resultant reaction mixture is placed in a container made, for example, of metal or glass. The container should be closed to prevent loss of water.

The zeolite may be satisfactorily prepared at temperatures of from about 90° C. to 200° C. the pressure being atmospheric or at least that corresponding to the vapor pressure of water in equilibrium with the mixture of reactants at the higher temperature. Any suitable heating apparatus, e.g., an oven, sand bath, oil bath or jacketed autoclave, may be used. Heating is continued until the desired crystalline zeolite product is formed. The zeolite crystals are then filtered off and washed to separate them from the reactant mother liquor. The zeolite crystals should be washed, preferably with distilled water, until the effluent wash water, in equilibrium with the product, has a pH of between about 9 and 12. As the zeolite crystals are washed, the exchangeable cation of the zeolite may be partially removed and is believed to be replaced by hydrogen cations. If the washing is discontinued when the pH of the effluent wash water is between about 10 and 11, the $(K_2O+Na_2O)/Al_2O_3$ molar ratio of the crystalline product will be approximately 1.0. Thereafter, the zeolite crystals may be dried, conveniently in a vented oven.

Zeolite L has been characterized in *Zeolite Molecular Sieves,* by Donald W. Breck, John Wiley & Sons, 1974, as having a framework comprising 18 tetrahedra unit cancrinite-type cages linked by double 6-rings in columns and crosslinked by single oxygen bridges to form planar 12-membered rings. These 12-membered rings produce wide channels parallel to the c-axis with no stacking faults. Unlike erionite and cancrinite, the cancrinite cages are symmetrically placed across the double 6-ring units. There are four types of cation locations: A in the double 6-rings, B in the cancrinite-type cages, C between the cancrinite-type cages, and D on the channel wall. The cations in site D appear to be the only exchangeable cations at room temperature. During dehydration, cations in site D probably withdraw from the channel walls to a fifth site, site E, which is located between the A sites. The hydrocarbon sorption pores are approximately 7 to 8 Angstroms in diameter.

A more complete description of these zeolites is given, e.g., in U.S. Pat. No. 3,216,789 which, more particularly, gives a conventional description of these zeolites. U.S. Pat. No. 3,216,789 is hereby incorporated by reference to show a type L zeolite useful in the present invention.

Zeolite L differs from other large pore zeolites in a variety of ways, besides X-ray diffraction pattern.

One of the most pronounced differences is in the channel system of zeolite L. Zeolite L has a one-dimensional channel system parallel to the c-axis, while most other zeolites have either two-dimensional or three-dimensional channel systems. Zeolite A, X and Y all have three-dimensional channel systems. Mordenite (Large Port) has a major channel system parallel to the c-axis, and another very restricted channel system parallel to the b-axis. Omega zeolite has a one-dimensional channel system.

Another pronounced difference is in the framework of the various zeolites. Only zeolite L has cancrinite-type cages linked by double-six rings in columns and crosslinked by oxygen bridges to form planar 12-rings. Zeolite A has a cubic array of truncated octahedra, beta-cages linked by double-four ring units. Zeolites X and Y both have truncated octahedra, beta-cages, linked tetrahedrally through double-six rings in an arrangement like carbon atoms in a diamond. Mordenite has complex chains of five-rings crosslinked by four-ring chains. Omega has a fourteen-hedron of gmelinite-type linked by oxygen bridges in columns parallel to the c-axis.

Presently, it is not known which of these differences, or other differences, is responsible for the high selectivity for dehydrocyclization of catalysts made from zeolite L, but it is known that catalysts made of zeolite L do react differently than catalysts made of other zeolites.

Various factors have an effect on the X-ray diffraction pattern of a zeolite. Such factors include temperature, pressure, crystal size, impurities, and type of cations present. For instance, as the crystal size of the type L zeolite becomes smaller, the X-ray diffraction pattern becomes broader and less precise. Thus, the term "zeolite L" includes any zeolites made up of cancrinite cages having an X-ray diffraction pattern substantially similar to the X-ray diffraction patterns shown in U.S. Pat. No. 3,216,789.

Crystal size also has an effect on the stability of the catalyst. For reasons not yet fully understood, catalysts having at least 80% of the crystals of the type L zeolite larger than 1000 Angstroms give longer run length than catalysts having substantially all of the crystals of the type L zeolite between 200 and 500 Angstroms. Thus, the larger of these crystallite sizes of type L zeolite is the preferred support.

Type L zeolites are conventionally synthesized largely in the potassium form, i.e., in the theoretical formula given previously, most of the M cations are potassium. The M cations are exchangeable, so that a given type L zeolite, e.g., a type L zeolite in the potassium form, can be used to obtain type L zeolites containing other cations, by subjecting the type L zeolite to ion exchange treatment in an aqueous solution of appropriate salts. However, it is difficult to exchange all of the original cations, e.g., potassium, since some exchangeable cations in the zeolite are in sites which are difficult for the reagents to reach.

Alkaline Earth Metals

A preferred, but not essential element of the present invention is the presence of an alkaline earth metal in the dehydrocyclization catalyst. That alkaline earth metal can be either barium, strontium or calcium. Preferably the alkaline earth metal is barium. The alkaline earth metal can be incorporated into the zeolite by synthesis, impregnation or ion exchange. Barium is preferred to the other alkaline earths because the resulting catalyst has high activity, high selectivity and high stability.

In one embodiment, at least part of the alkali metal is exchanged with barium, using techniques known for ion exchange of zeolites. This involves contacting the zeolite with a solution containing excess $Ba^{++}$ ions. The barium should preferably constitute from 0.1% to 35% of the weight of the zeolite, more preferably from 1% to 20% by weight.

Group VIII Metals

The dehydrocyclization catalysts according to the invention are charged with one or more Group VIII metals, e.g., nickel, ruthenium, rhodium, palladium, iridium or platinum.

The preferred Group VIII metals are iridium and particularly platinum, which are more selective with regard to dehydrocyclization and are also more stable under the dehydrocyclization reaction conditions than other Group VIII metals.

The preferred percentage of platinum in the catalyst is between 0.1% and 5%, more preferably from 0.1% to 1.5%.

Group VIII metals are introduced into the zeolite by synthesis, impregnation or exchange in an aqueous solution of an appropriate salt. When it is desired to introduce two Group VIII metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion exchange process, platinum can be introduced by using cationic platinum complexes such as tetrammineplatinum (II) nitrate.

Catalyst Pellets

An inorganic oxide can be used as a carrier to bind the large pore size zeolite containing the Group VIII metal and alkaline earth metal and give the dehydrocyclization catalyst additional strength. The carrier can be a natural or a synthetically produced inorganic oxide or combination of inorganic oxides. Preferred loadings of inorganic oxide are from 5% to 35% by weight of the catalyst. Typical inorganic oxide supports which can be used include aluminosilicates (such as clays), alumina, and silica, in which acidic sites are preferably exchanged by cations which do not impart strong acidity.

When an inorganic oxide is used as a carrier, there are two preferred methods in which the catalyst can be made, although other embodiments could be used.

In the first preferred embodiment, the zeolite is made, then the zeolite is ion exchanged with a barium solution, separated from the barium solution, dried and calcined, impregnated with platinum, calcined, and then mixed with the inorganic oxide and extruded through a die to form cylindrical pellets, then the pellets are dried and calcined. Advantageous methods of separating the zeolite from the barium and platinum solutions are by a batch centrifuge or a pressed filter. This embodiment has the advantage that all the barium and platinum are incorporated on the zeolite and none are incorporated on the inorganic oxide. It has the disadvantage that the large-pore zeolite is of small size, which is hard to separate from the barium solution and the platinum solution.

In the second preferred embodiment, the large-pore zeolite is mixed with the inorganic oxide and extruded through the die to form cylindrical pellets, then the pellets are dried and calcined, then these pellets are ion exchanged with a barium solution, separated from the barium solution, impregnated with platinum, separated from the platinum solution, and calcined. This embodiment has the advantage that the pellets are easy to separate from the barium and platinum solutions.

After the desired Group VIII metal or metals have been introduced, the catalyst is treated in air at about 260° C. and then reduced in hydrogen at temperatures of from 200° C. to 700° C., preferably 300° C. to 620° C.

At this stage the dehydrocyclization catalyst is ready for use in the dehydrocyclization process.

In order to obtain optimum selectivity, temperature should be adjusted so that reaction rate is appreciable, but conversion is less than 98%, as excessive temperature and excess reaction can have an adverse affect on selectivity. Pressure should also be adjusted within a proper range. Too high a pressure will place a thermodynamic (equilibrium) limit on the desired reaction, especially for hexane aromatization, and too low a pressure may result in coking and deactivation.

Another advantage of this invention is that the catalyst of the present invention is more stable than prior art zeolitic catalysts. Stability of the catalyst, or resistance to deactivation, determines its useful run length. Longer run lengths result in less down time and expense in regenerating or replacing the catalyst charge.

After the reformate is produced, the reformate can be passed through a high pressure separator where light gases, such as hydrogen, methane and $C_2$ product are separated from the balance of the reformate and are recycled back to the reformer. The remaining $C_3+$ fraction of the reformate can be used as the reformate contacted with the intermediate pore size zeolite. If desired, the $C_3+$ fraction can be passed through a debutanizer to remove $C_4-$ materials from the reformate, but better yields are achieved in the upgrading process if the $C_3+$ fraction is used as the reformate instead of using only the $C_5+$ fraction.

In the present invention, the reformate or aromatic containing material is contacted with an intermediate pore size zeolite at a temperature of from 800° to 1100° F., an LHSV of from 0.1 to 10, and an $H_2$/HC of from 0 to 6. The intermediate pore size zeolite can be bound using conventional binders.

The intermediate pore size zeolites used in the process are crystalline aluminosilicate zeolites having a silica to alumina mol ratio greater than about 10:1 and preferably greater than about 40:1. These zeolites have useful activity even at high silica to alumina mol ratios such as 1000 to 2000:1.

By "intermediate pore size," as used herein, is meant an effective pore aperture in the range of about 5 to 6.5 Angstroms when the zeolite is in the H-form. Zeolites having pore apertures in this range tend to have unique molecular sieving characteristics. Unlike small pore zeolites such as erionite, they will allow hydrocarbons having some branching into the zeolitic void spaces.

The effective pore size of the zeolites can be measured using standard adsorption techniques and hydrocarbonaceous compounds of known minimum kinetic diameters. See Breck, *Zeolite Molecular Sieves,* 1974 (especially Chapter 8) and Anderson et al., J. Catalysis 58, 114 (1979), both of which are incorporated by reference.

Intermediate pore size zeolites in the H-form will typically admit molecules having kinetic diameters of 5 to 6 Angstroms with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5 Angstroms can be admitted into the pores, depending on the particular zeolite, but do not penetrate as quickly and in some cases, are effectively excluded (for example, 2,2-dimethylbutane is excluded from H-ZSM-5). Compounds having kinetic diameters in the range of 6 to 6.5 Angstroms include: cyclohexane (6.0), 2,3-dimethylbutane (6.1), 2,2-dimethylbutane (6.2), m-xylene (6.1), and 1,2,3,4-tetramethylbenzene (6.4). Generally, compounds having kinetic diameters of greater than about 6.5 Angstroms cannot penetrate the pore apertures and thus cannot be adsorbed in the interior of the zeolite. Examples of such larger compounds include: o-xylene (6.8), hexamethylbenzene (7.1), 1,3,5-trimethylbenzene (7.5), and tributylamine (8.1).

The preferred effective pore size range is from about 5.3 to about 6.2 Angstroms. ZSM-5, ZSM-11, and silicalite, for example, fall within this range.

In performing adsorption measurements to determine pore size, standard techniques are used. It is convenient to consider a particular molecule as excluded if it does not reach at least 95% of its equilibrium adsorption value on the zeolite in less than about 10 minutes (P/Po=0.5, 25° C.).

Examples of intermediate pore size zeolites include CZH-5, silicalite and members of the ZSM series such as ZSM-5, ZSM-11, ZSM-12, ZSM-21, ZSM-23, ZSM-35, and ZSM-38. CZH-5 is described in Ser. No. 166,863, filed July 7, 1980, and now abandoned incorporated herein by reference. ZSM-5 is described in U.S. Pat. Nos. 3,702,886 and 3,770,614; ZSM-11 is described in U.S. Pat. No. 3,709,979; ZSM-12 is described in U.S. Pat. No. 3,832,449; ZSM-21 is described in U.S. Pat. No. 3,948,758; and silicalite is described in U.S. Pat. No. 4,061,724. These patents are incorporated by reference. The preferred zeolites are ZSM-5, silicalite, ZSM-11, and mixtures thereof.

EXAMPLES

The invention will be further illustrated by the following examples which set forth a particularly advantageous method and composition embodiments. While the examples are provided to illustrate the present invention, they are not intended to limit it.

A feed was used having an API Gravity of 65.7, and an ASTM Method D-86 distillation of: start pt.—162° F., 5%—183° F., 50%—227° F., 95%—287° F., end pt.—411° F. This feed contained 75.1% paraffins, 18.7% naphthenes, 5.6% aromatics, and 0.6% unclassified.

This feed was run over a reforming catalyst at a catalyst average temperature of 890° F., a pressure of 125 psig, 1.5 LHSV, and 4.4 $H_2$/HC with product recycle, to 59 wt % aromatics in the liquid product. The liquid yield was 83.7 LV%.

The reforming catalyst had been formed by the procedure of putting a type L zeolite of crystallite size greater than 1000 Angstroms as determined by X-ray diffraction into a ten times excess of a solution of 0.3 molar $Ba(NO_3)_2$ in $H_2O$. This solution was placed in a closed container in an oven for 3 hours at 80° C., then the solids were filtered and washed with a ten times excess of water. The solids were then dried overnight at 250° F. in air, calcined at 1100° F. for 16 hours in air, and screened to 24/80 mesh, and then a solution of $Pt(NH_3)_4(NO_3)_2$ in water was added to an amount equal to 0.8% Pt by weight of zeolite. The resulting catalyst was dried overnight at 250° F. in air, and calcined for 2 hours at 500° F. in air. The catalyst was prereduced before the hydrocarbon feed was introduced.

Gas chromatograph inspections of the reforming product were 18.90 vol % normal paraffins, 21.48% isoparaffins, 2.33% naphthenes, 0.51% olefins, and 50.64% aromatics. The octanes, by gas chromatograph, were 75.82 F-1, 70.49 F-2. The reforming yield of aromatics from the feed was 42.39 LV%.

The reforming product was then run over a ZSM-5 catalyst, H-form, containing zinc. Two different conditions were tried. The first set of conditions were 920° F., 100 psig, 6 LHSV, 6 $H_2$/HC. Data is shown for 2 hours on stream. The second set of conditions were 1000° F., 50 psig, 6 LHSV, 1 $H_2$/HC. Data is shown for 6 and 16 hours on stream. Yields, excluding hydrogen, follow.

TABLE I

| | I 2 hrs. | II 6 hrs. | II 16 hrs. |
|---|---|---|---|
| Wt% $C_1$ | 1.86 | 3.75 | 4.05 |
| Wt % $C_2$ | 4.11 | 5.66 | 6.17 |
| Wt % $C_3$ | 11.28 | 12.47 | 13.69 |
| Wt % $iC_4$ | 9.07 | 4.22 | 4.89 |
| Wt % $nC_4$ | 4.23 | 3.02 | 3.51 |
| Wt % $C_5$+ liquid of feed reformate | 64.61 | 65.40 | 61.88 |
| Aromatics produced as LV % of feed reformate | 52.37 | 58.47 | 55.96 |
| Aromatics produced as LV % of feed overall | 43.83 | 48.94 | 46.84 |
| F-1 Octane | 100.10 | 104.94 | 107.89 |
| F-2 Octane | 91.09 | 94.98 | 97.37 |

Thus, high octane liquids are produced, also producing more aromatics than present in the reforming product.

While the present invention has been described with reference to specific embodiments, this application is intended to cover those various changes and substitutions which may be made by those skilled in the art without departing from the spirit and scope of the appended claims.

What is claimed is:

1. A hydrocarbon conversion process comprising:

(a) contacting a hydrocarbon feed with a dehydrocyclization catalyst at dehydrocyclization conditions to form a reformate, wherein at least part of said dehydrocyclization catalyst comprises a large-pore zeolite containing at least one Group VIII metal; and (b) contacting said reformate with an intermediate pore size zeolite at a temperature of from 800° F. to 1100° F., an LHSV of from 0.1 to 10, and an $H_2$/HC of from 0 to 6.

2. A hydrocarbon conversion process according to claim 1 wherein said large-pore zeolite contains an alkaline earth metal selected from the group consisting of barium, strontium, and calcium, and wherein said Group VIII metal is platinum.

3. A hydrocarbon conversion process according to claim 2 wherein said dehydrocyclization catalyst has from 0.1% to 35% by weight barium and from 0.1% to 5% by weight platinum.

4. A hydrocarbon conversion process according to claim 3 wherein said dehydrocyclization catalyst has from 1% to 20% by weight barium and from 0.1% to 1.5% by weight platinum.

5. A hydrocarbon conversion process according to claim 1 wherein said large-pore zeolite has an apparent pore size of from 7 to 9 Angstroms.

6. A hydrocarbon conversion process according to claim 5 wherein said large-pore zeolite is selected from the group consisting of zeolite X, zeolite Y, and type L zeolite.

7. A hydrocarbon conversion process according to claim 6 wherein said large-pore zeolite is zeolite Y.

8. A hydrocarbon conversion process according to claim 6 wherein said large-pore zeolite is a type L zeolite.

9. A hydrocarbon conversion process according to claim 8 wherein the majority of the crystals of said type L zeolite are larger than 500 Angstroms.

10. A hydrocarbon conversion process according to claim 9 wherein the majority of the crystals of said type L zeolite are larger than 1000 Angstroms.

11. A hydrocarbon conversion process according to claim 10 wherein at least 80% of the crystals of said type L zeolite are larger than 1000 Angstroms.

12. A hydrocarbon conversion process according to claim 1 wherein said dehydrocyclization catalyst comprises:

(a) a large-pore zeolite containing barium and platinum; and (b) an inorganic binder.

13. A hydrocarbon conversion process according to claim 12 wherein said inorganic binder is selected from the group consisting of silica, alumina, and aluminosilicates.

14. A hydrocarbon conversion process according to claim 1 wherein said contacting in step (a) occurs at a temperature of from 400° C. to 600° C.; an LHSV of from 0.1 to 10; a pressure of from 1 atmosphere to 500 psig; and an $H_2$/HC ratio of from 0 to 20:1.

15. A hydrocarbon conversion process according to claim 14 wherein said contacting in step (a) occurs at a temperature of from 450° C. to 550° C.; an LSHV of from 0.3 to 10; a pressure of from 50 to 200 psig; and an $H_2$/HC ratio of from 2:1 to 6:1.

16. A hydrocarbon conversion process according to claim 1 wherein step (b) is conducted at a pressure of from atmospheric pressure to 200 psig.

17. A hydrocarbon conversion process according to claim 1 wherein said intermediate pore size zeolite contains zinc.

18. A hydrocarbon conversion process according to claim 1 wherein said intermediate pore size zeolite is selected from the group consisting of ZSM-5, silicalite, ZSM-11, and mixtures thereof.

19. A hydrocarbon conversion process according to claim 1 wherein said reformate contains at least 25 LV% aromatics.

20. A hydrocarbon conversion process according to claim 1 wherein said reformate comprises the $C_3$+ fraction product of step (a).

21. A hydrocarbon conversion process according to claim 1 wherein said hydrocarbon feed is reformed to at least 75 F-1, clear in step (a).

22. A hydrocarbon conversion process according to claim 1 wherein said reformate is contacted with said intermediate pore size zeolite at a temperature of at least 850° F., an LHSV of from 0.1 to 2, and an $H_2$/HC of less than 3.

23. A hydrocarbon conversion process according to claim 1 wherein said reformate is contacted with said intermediate pore size zeolite at an LHSV of no more than 1 and an $H_2$/HC of about 0.

24. A hydrocarbon conversion process comprising:

(a) contacting a hydrocarbon feed with a dehydrocyclization catalyst at dehydrocyclizating conditions to form a reformate containing at least 25 LV% aromatics and having at least 75 F-1, clear; wherein said dehydrocyclization catalyst comprises:

(i) a type L zeolite containing from 1% to 20% by weight barium and from 0.1% to 1.5% by weight platinum, wherein at least 80% of the crystals of said type L zeolite are larger than 1000 Angstroms; and (ii) an inorganic binder selected from the group consisting of silica, alumina, and aluminosilicates; wherein said contacting occurs at a temperature of from 450° C. to 550° C.; an LSHV of from 0.3 to 5; a pressure of from 50 to 200 psig; and an $H_2$/HC ratio of from 2:1 to 6:1; and (b) contacting the $C_3$+ fraction product of said reformate with an intermediate pore size zeolite at a temperature of from 850° F. to 1100° F., an LHSV of from 0.1 to 1.0, a pressure of from atmospheric pressure to 100 psig, and an $H_2$/HC of about 0; wherein said intermediate pore size zeolite is selected from the group consisting of ZSM-5, silicalite, ZSM-11, and mixtures thereof; wherein said intermediate pore size zeolite contains zinc.

* * * * *